US009511931B1

(12) United States Patent
Pedersen

(10) Patent No.: US 9,511,931 B1
(45) Date of Patent: Dec. 6, 2016

(54) METHODS AND SYSTEMS FOR WASTE CONTAINMENT

(71) Applicant: THE BOEING COMPANY, Huntington Beach, CA (US)

(72) Inventor: Aaron John Pedersen, Summerville, SC (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 14/938,064

(22) Filed: Nov. 11, 2015

(51) Int. Cl.
*B65D 33/00* (2006.01)
*B65F 1/00* (2006.01)
*B65F 1/14* (2006.01)

(52) U.S. Cl.
CPC ..... *B65F 1/0006* (2013.01); *B65F 1/1415* (2013.01); *B65F 2240/137* (2013.01)

(58) Field of Classification Search
CPC ..... B65D 67/1205; B65D 67/1255
USPC ..... 383/33–34.1; 248/99–101
See application file for complete search history.

(56) References Cited

U.S. PATENT DOCUMENTS

| | | | |
|---|---|---|---|
| 4,951,831 | A | 8/1990 | Roesch et al. |
| 6,993,891 | B2 | 2/2006 | Richardson et al. |
| 2002/0179608 | A1 | 12/2002 | Prell et al. |
| 2011/0079599 | A1 | 4/2011 | MacEwan et al. |

OTHER PUBLICATIONS

Dornob.com, Flexibin, http://dornob.com, date retrieved Nov. 11, 2015, pp. 2.
Dornob,com, Funky Flexible Garbage Bin Fits Any Bag, Bends to Your Will, http://dornob.com, date retrieved Nov. 11, 2015, pp. 6.
Uncommongoods, Urbano Eco Trash Can, http://www.uncommongoods.com, date retrieved Nov. 11, 2015, pp. 1.
Walmart.com, Rubbermaid 5-Gallon Hidden Recycle Bin, www.walmart.com, date retrieved Nov. 11, 2015, pp. 1.
Camping World, Trash-Ease, www.campingworld.com, date retrieved Nov. 11, 2015, pp. 1.

*Primary Examiner* — Jes F Pascua
(74) *Attorney, Agent, or Firm* — Armstrong Teasdale LLP

(57) ABSTRACT

A waste containment system includes a flexible bag having a top opening and a flexible wire coupled to the bag. The wire is positioned about the top opening and configured to define a shape of the top opening. The system also includes a flexible frame including a first attachment mechanism configured to couple the frame to a structure, and a second attachment mechanism configured to couple the frame to at least one of the wire and the bag. Manipulation of the wire causes the frame to change in shape such that the shape of the frame at least partially corresponds to the shape of the top opening.

20 Claims, 8 Drawing Sheets

METHODS AND SYSTEMS FOR WASTE CONTAINMENT

BACKGROUND

The field of the disclosure relates generally to waste containment systems, and more specifically, to capturing waste created by drilling into structures.

At least some known manufacturing facilities include structures requiring holes to be drilled therethrough for receiving fasteners. When holes are drilled in a structure, waste particles and/or shavings are generated. Some of these particles/shavings may be hot from the friction produced during the drilling process. Still other particles/shavings may include fibers (glass or carbon) that can be irritating to skin. Not only may these particles/shavings cause a safety concern, they may become foreign object debris (FOD) that can cause monetary penalties if found in a delivered product.

Accordingly, workers attempt to collect the particles/shavings as they are generated. For example, a vacuum can be used, but a power or pneumatic source is required for the vacuum. As another example, a standard trash bag can be taped up where the drilling occurs. However, several problems exist when using a standard trash bag: 1) it needs to be held open; 2) it isn't resistant to hot particles (e.g., it melts); and 3) the tape can give way and the bag will fall and spill the contents. As one solution, one worker holds the bag while another worker drills into the structure. In this situation, the worker holding the bag cannot do other work and may be exposed to hot/irritating waste particles. Because of these concerns, some workers don't use a vacuum or a trash bag and merely let the particles/shavings fall for later clean-up. However, the later clean-up may not be sufficient to avoid FOD and/or may allow particles/shavings to fall on workers walking or working that do not realize the lack of containment.

BRIEF DESCRIPTION

In one aspect, a waste containment system is provided. The waste containment system includes a flexible bag having a top opening and a flexible wire coupled to the bag. The wire is positioned about the top opening and configured to define a shape of the top opening. The system also includes a flexible frame including a first attachment mechanism configured to couple the frame to a structure, and a second attachment mechanism configured to couple the frame to at least one of the wire and the bag. Manipulation of the wire causes the frame to change in shape such that the shape of the frame at least partially corresponds to the shape of the top opening.

In another aspect, a method of forming a waste containment system is provided. The method includes coupling a flexible wire about a top opening of a flexible bag, wherein the wire defines a shape of the top opening. The method also includes coupling at least one of the bag and the wire to a flexible frame. Manipulation of the wire causes the frame to change in shape such that the shape of the frame at least partially corresponds to the shape of the top opening.

In yet another aspect, a method of operating a waste containment system is provided. The method includes coupling a flexible frame to a structure using a first attachment mechanism and coupling a flexible wire about a top opening of a flexible bag such that the wire defines a shape of the top opening. The method also includes coupling at least one of the bag and the wire to the frame and manipulating the wire to change the shape of the top opening. Manipulating the wire causes the frame to change in shape such that the shape of the frame at least partially corresponds to the shape of the top opening.

The features, functions, and advantages that have been discussed can be achieved independently in various embodiments or may be combined in yet other embodiments, further details of which can be seen with reference to the following description and drawings.

DETAILED DESCRIPTION

The examples described herein facilitate containing various types of waste in a flexible bag mounted to a structure into which a technician drills. The waste containment system herein described includes a frame, a wire, and a bag that are each flexible so the system can be configured in any desirable shape or profile. One implementation includes adhesive that allows the system to be positioned where it is needed (e.g., directly below a drilling location), so a technician will be more likely to use the system, which prevents FOD and hot (e.g., metal) and/or irritating (e.g., carbon fiber) particles from contacting other workers' skin. The adhesive can be selected to allow the frame to be positioned and re-positioned as the worker moves along the structure being drilled. Alternatively, the adhesive can be a one-time use adhesive. In an alternative example, the system can include a mechanical attachment mechanism, such as a hook or hole. The mechanical attachment mechanism and the adhesive can both be included to give the worker options. Either option will prevent the bag from falling and spilling out its contents.

Figure 1:
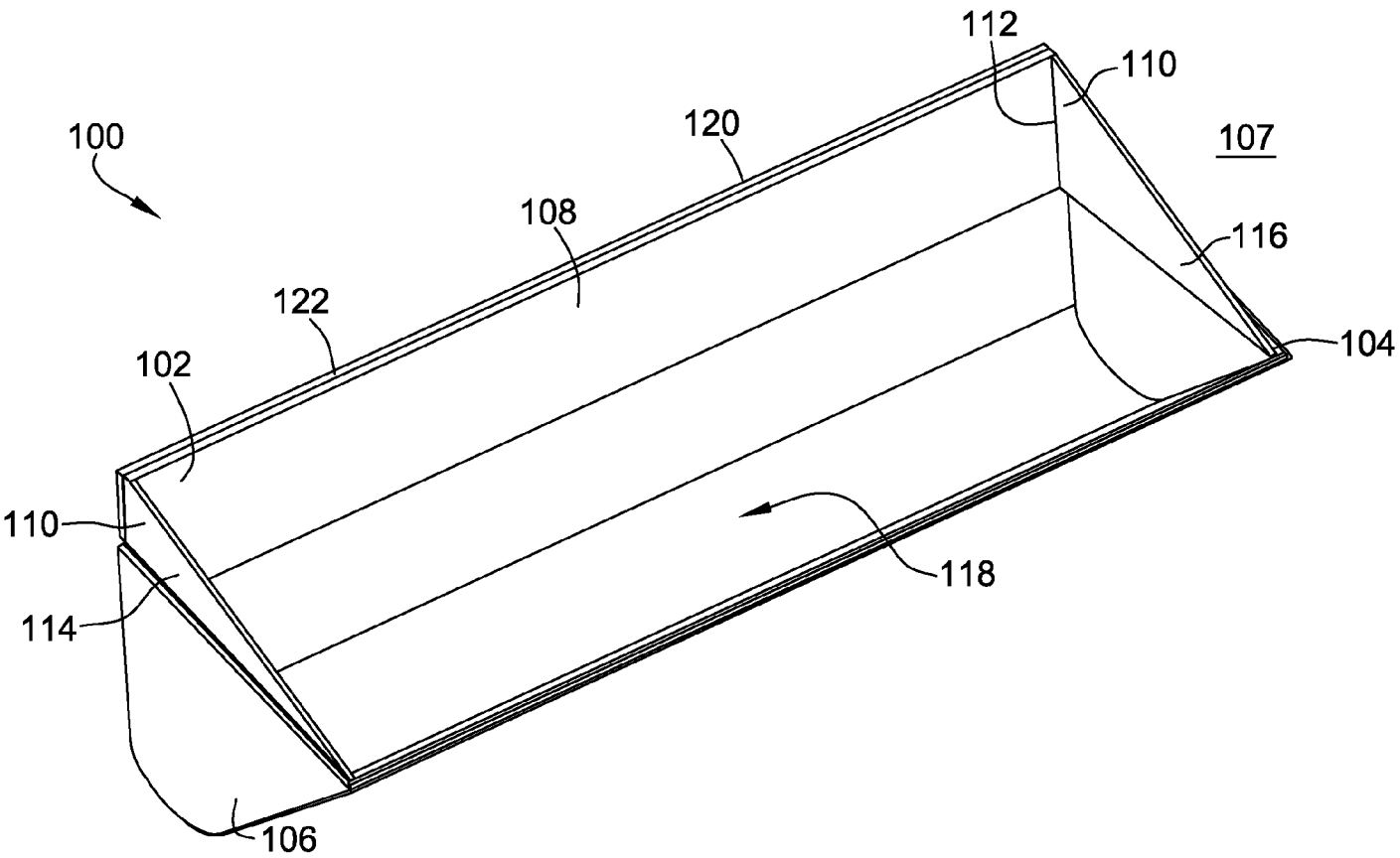
FIG. 1 is a perspective view of an exemplary waste containment system.

FIG. 1 is a perspective view of an exemplary waste containment system 100 including a frame member 102, a moldable wire 104, and a waste containment bag 106. In the exemplary implementation, each of frame 102, wire 104, and bag 106 are flexible to facilitate a technician to form system 100 into a desired shape or profile during use while system 100 is coupled to a structure 107. Frame 102 includes a rear wall 108 and a pair of sidewalls 110 extending substantially parallel to each other from opposing ends of rear wall 108 and are tapered in shape. In the exemplary implementation, rear wall 108 and sidewalls 110 are integrally formed as a single piece component. Alternatively, rear wall 108 and sidewalls 110 are pivotally coupled to enable sidewalls 110 to rotate with respect to rear wall 108. In either configuration, frame 102 includes hinge lines or score lines 112 that function as lines of weakness that facilitate rotation of sidewalls 110 with respect to rear wall 108 and also enable sidewalls 110 to fold against rear wall 108 such that frame 108 flattens for storage or shipping. Although the FIG. 1 illustrates sidewalls 110 as being substantially perpendicular to rear wall 108 at hinge lines 112, the transition between rear wall 108 and sidewalls 110 at hinge lines 112 may also be curved.

In the exemplary implementation, frame 102 is formed from a fire-retardant material. More specifically, rear wall 108 and sidewalls 110 are formed from a material that can withstand contact with high temperature waste particles without deformation. In one implementation, rear wall 108 and sidewalls 110 are formed from the same material. In another implementation, rear wall 108 and sidewalls 110 are formed from different materials. Generally, frame 102 is formed from any material that is flexible enough to allow the shape of frame 102 to be manipulated but also rigid enough to provide support to wire 104 and bag 106.

Figure 2:
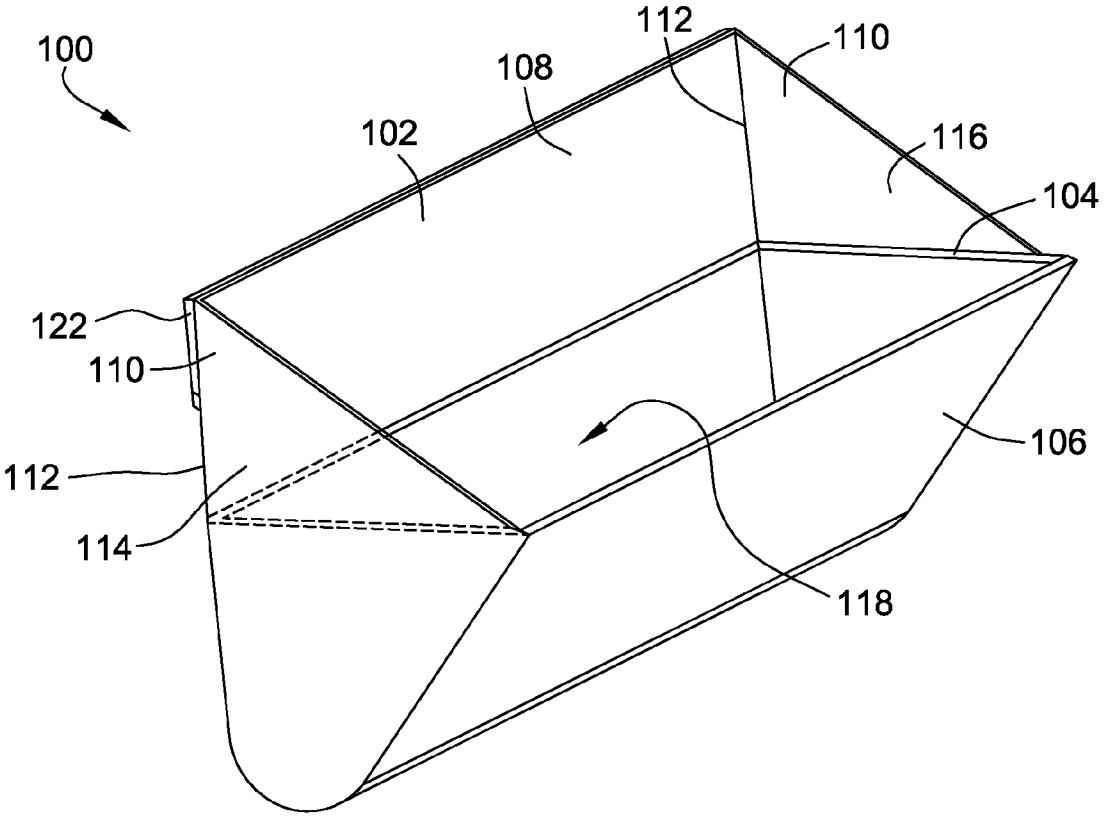
FIG. 2 is a perspective view of an alternative embodiment of a waste containment system.

Frame 102 includes an outer surface 114 and an inner surface 116. In the exemplary implementation, wire 104 and bag 106 are removably coupled to outer surface 114 between frame 102 and structure 107 to enable bag 106 to be emptied or discarded before replacing bag 106, or a new bag 106, onto frame 102. As described in further detail below, such a configuration enables bag 106 to be changed when full without having to dispose of frame 102 and may include that frame 102 be removed and replaced on structure 107 to remove bag 106. In another implementation, as shown in FIG. 2, wire 104 and bag 106 are removably coupled to inner surface 116 to enable bag 106 to be emptied or discarded before replacing bag 106 or a new bag 106 onto frame 102. As described in further detail below, such a configuration enables bag 106 to be changed when full without having to dispose of frame 102 and without removing frame 102 from structure 107.

In the exemplary implementation, flexible bag 106 includes a top opening 118 and flexible wire 104 is coupled to bag 106 such that wire 106 is positioned about top opening 118 and configured to define the shape of top opening 118. More specifically, the technician manipulates wire 104 to define a desired optimum shape of top opening 118 that facilitates catching and containing a maximum amount of waste created. In the exemplary implementation, wire 104 is formed integrally with bag 106 such that bag 106 is molded around wire 104. Alternatively, wire 104 and bag 106 are separable components. Wire 104 is formed from any material that is moldable by a technician and also maintains its molded shape to provide support to bag 106 and define top opening 118. In another example, wire 104 is moldable by a technician and then returns to its original state when the force is removed. Similar to frame 102, bag 106 is formed from a fire-retardant plastic material. More specifically, bag 106 is formed from a material that can withstand contact with high temperature waste particles without deformation, such as melting. Additionally, bag 106 is formed from liquid impermeable material that catches and contains liquids that may be used for lubrication during working conditions.

As described herein, wire 104 is flexible such that a technician is a able mold wire 104 to define a desired shape of top opening 118 of bag 106, but also rigid enough to maintain its shape to provide structure for bag 106 and to maintain deformations in frame 102 as a result of molding wire 104. As such, manipulating wire 104 to change the shape of top opening causes frame 102 to change in shape such that the shape of deformed frame 102 at least partially corresponds to the shape of top opening 118 as defined by wire 104. Accordingly, a technician deforms wire 104 in order to catch and contain a maximum amount of waste created during working conditions.

Figure 3:
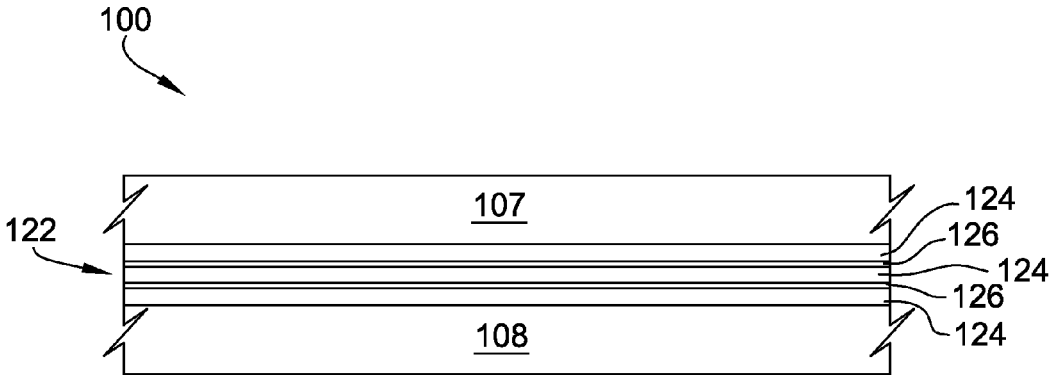
FIG. 3 is a top view of either of the waste containment systems shown in FIG. 1 or 2 illustrating an exemplary first attachment mechanism.

FIG. 3 is a top view waste containment system 100 an exemplary first attachment mechanism 120 that couples rear wall 108 of frame 102 to structure 107. In the exemplary implementation, first attachment mechanism 120 includes an adhesive 122 coupled between frame 102 and structure 107. Adhesive 122 extends along at least a portion of outer surface 114 of rear wall 108, and, in one implementation, is removable from both rear wall 108 and from structure 107. In such a configuration, adhesive 122 is removable from structure 107 without damaging structure 107 or leaving residue and is also removable from rear wall 108 to facilitate re-use through cleaning adhesive 122 to remove waste debris and replacing the adhesive 122 onto rear wall 108. In another implementation, as shown in FIG. 3, adhesive 122 includes a plurality of alternating adhesive layers 124 and separating layers 126. As such, when the technician desires to re-position system 100, frame 102 is removed from structure 107 and the used adhesive layer 124 is removed along with the outermost separating layer 126 to reveal an un-used adhesive layer 124 for coupling to structure 107 at the next desired location. In the exemplary implementation, adhesive 122 is formed from a material that is free of silicone due to silicone's propensity to decrease the service lifetime of composite components, such as carbon fiber. Alternatively, adhesive 122 is formed from any material that facilitates operation of waste containment system 100 as described herein.

Figure 4:
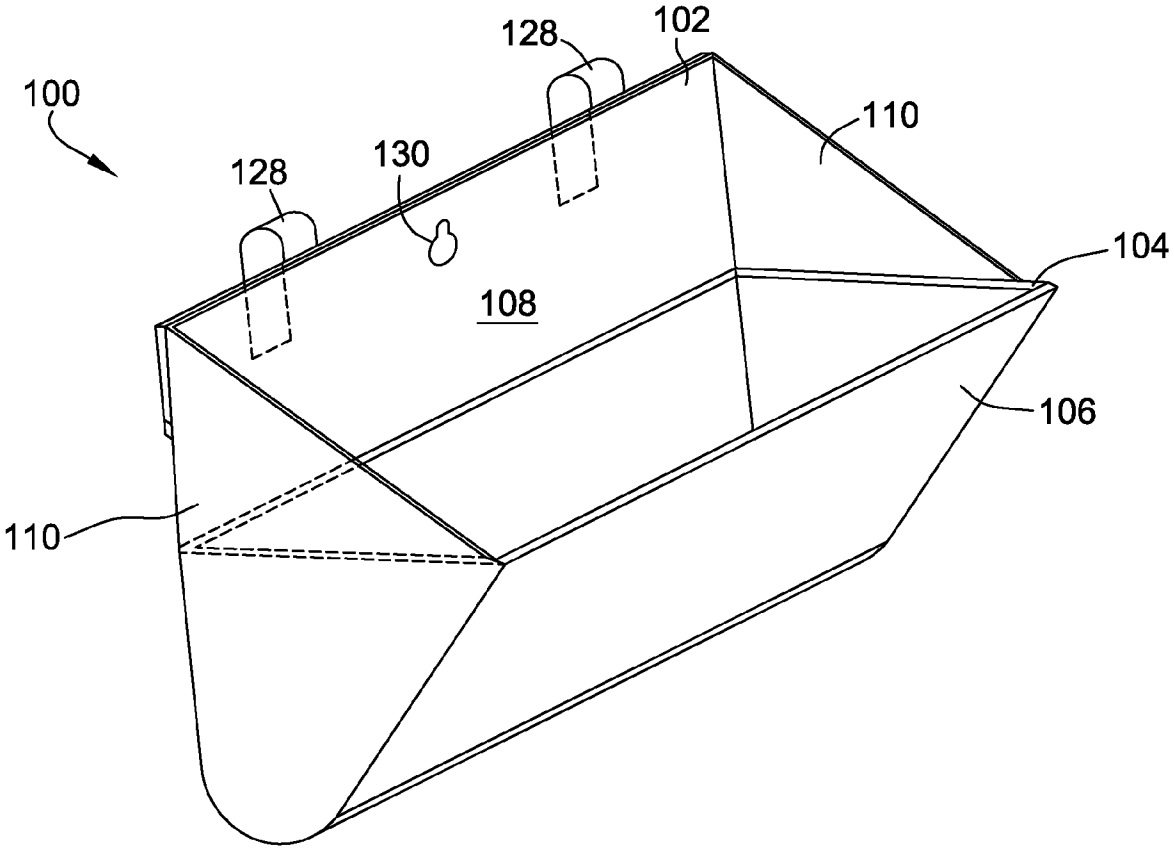
FIG. 4 is a perspective view of either of the waste containment systems shown in FIG. 1 or 2 illustrating alternative first attachment mechanisms.

FIG. 4 is a perspective view waste containment system 100 illustrating alternative first attachment mechanisms 120 that couple rear wall 108 of frame 102 to structure 107. In one implementation, first attachment mechanism 120 includes at least one hook 128 coupled to rear wall 108 to facilitate hanging system 100 on an edge of structure 107. In another implementation, first attachment mechanism 120 includes at least one opening 130 formed in rear wall 108. Opening 130 is configured to receive a fastener (not shown) inserted therethrough to facilitate coupling system 100 to structure 107. As such, first attachment mechanism 120 includes at least one of hook 128, opening 130 configured to receive a fastener, and adhesive 122.

Figure 5:
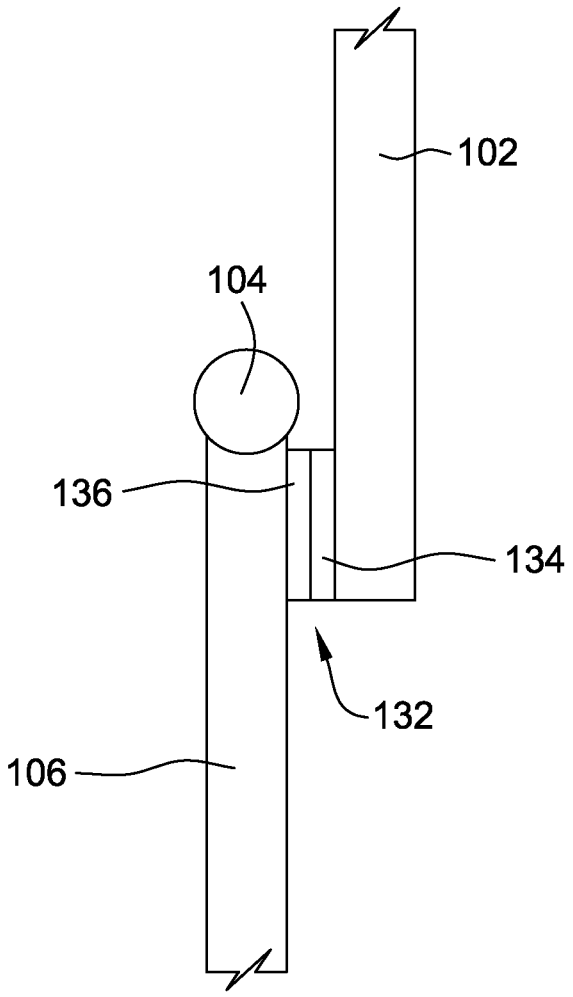
FIG. 5 is a side view of either of the waste containment systems shown in FIG. 1 or 2 illustrating an exemplary second attachment mechanism.

FIG. 5 is a side view of waste containment system 100 illustrating an exemplary second attachment mechanism 132 that couples at least one of bag 106 and wire 104 to frame 102. In the exemplary implementation, second attachment mechanism 132 includes one of a hook or loop fastener 134 coupled to frame 102 and the remaining hook or loop fastener 136 coupled to bag 106. More specifically, in one implementation, hook or loop fastener 134 extends along portions of outer surface 114 of sidewalls 110 and rear wall 108 and releasably couples to the remaining hook or loop fastener 136 on bag 106 proximate top opening 118. Alternatively, hook or loop fastener 134 extends along portions of inner surface 116 of sidewalls 110 and rear wall 108 and releasably couples to the remaining hook or loop fastener 136 on bag 106 proximate top opening 118.

Figure 6:
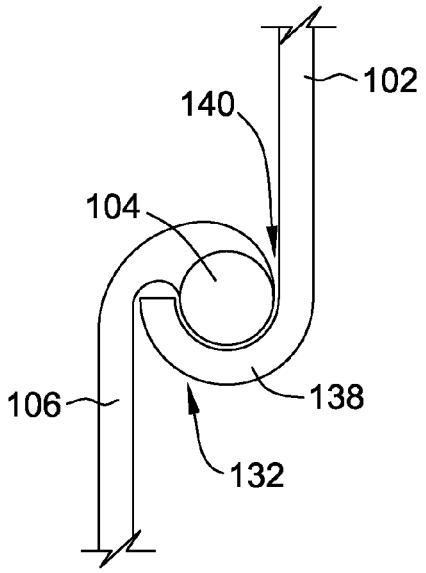
FIG. 6 is a side view of either of the waste containment systems shown in FIG. 1 or 2 illustrating an alternative second attachment mechanism.

FIG. 6 is a side view of waste containment system 100 illustrating an alternative second attachment mechanism 132 that couples at least one of bag 106 and wire 104 to frame 102. In one implementation, second attachment mechanism 132 includes a curved lip 138 formed on frame 102. More specifically, lip 138 is formed on rear wall 108 and sidewalls 110 and forms a groove 140. Groove 140 is sized and shaped to removably receive wire 104, having bag 106 thereto, positioned therein. In one implementation, lip 138 curves outward such that wire 104 is coupled to outer surface 114. In another implementation, lip 138 curves inward such that wire 104 is coupled to inner surface 114.

Figure 7:
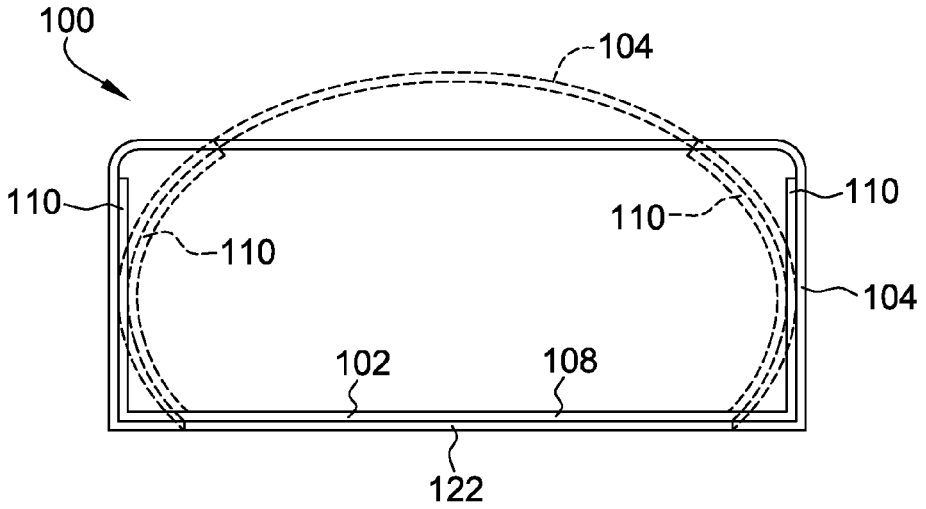
FIG. 7 is a top view of the waste containment system shown in FIG. 1 in operation.

FIG. 7 is a top view of the waste containment system shown in FIG. 1 in operation. In the exemplary implementation, each of frame 102, wire 104, and bag 106 are flexible to facilitate enabling a technician to form system 100 into a desired shape or profile during use, while system 100 is coupled to a structure 107. As described herein, wire 104 is flexible such that a technician is able mold wire 104 to define a desired shape of top opening 118 of bag 106, but also rigid enough to maintain its shape to provide structure for bag 106 and to maintain deformations in frame 102 as a result of molding wire 104. More specifically, in operation, system 100 appears in a first configuration shown in solid lines. During use, a technician manipulates wire 104 to change the shape of top opening 118 to contain a maximum amount of waste within bag 106. For example, a technician may manipulate wire 104 such that system 100 appears in a second configuration shown in broken lines. As shown, wire 104 is pulled outward away from rear wall 108. Such manipulation causes sidewalls 110 and the end portions of rear wall 108 to bend and flex to accommodate the desired shape of top opening 118. When the technician has defined top opening 118 as desired, wire 104 maintains the flexure of frame 102 and the desired shape of top opening 118. As such, manipulating wire 104 to change the shape of top opening causes frame 102 to change in shape such that the shape of deformed frame 102 at least partially corresponds to the shape of top opening 118 as defined by wire 104. Accordingly, a technician deforms wire 104 in order to catch and contain a maximum amount of waste created during working conditions.

Figure 8:
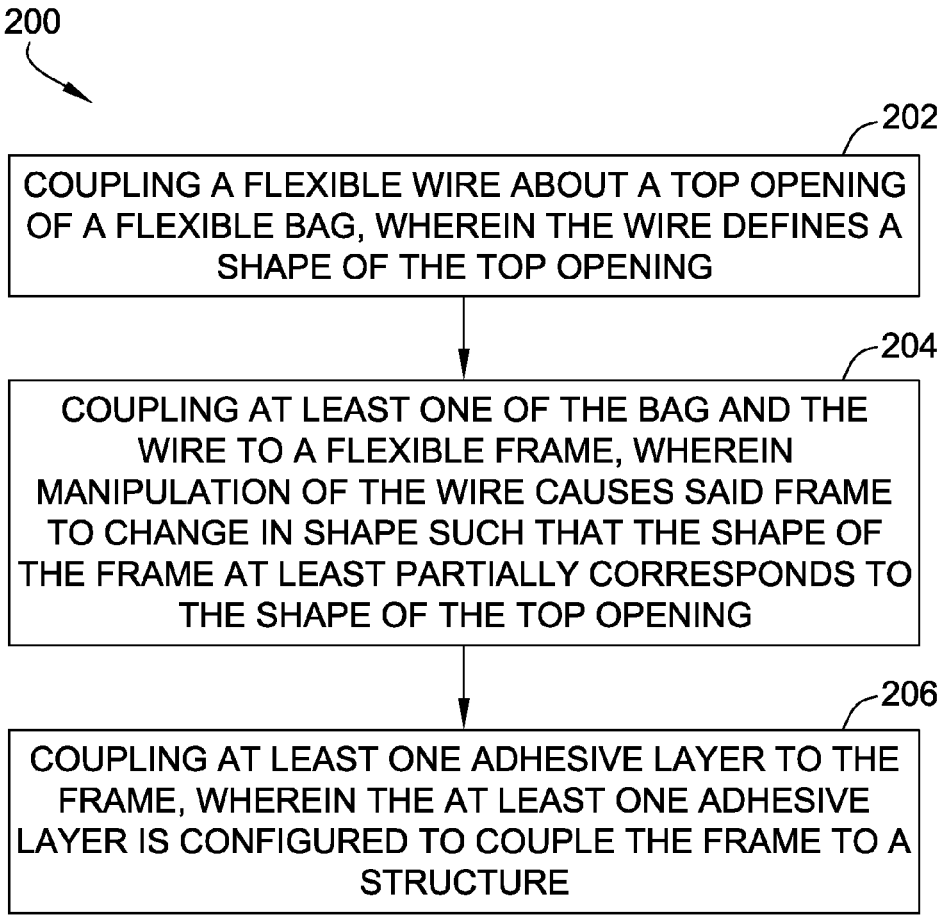
FIG. 8 is a schematic flow chart illustrating a method of forming either of the waste containment systems shown in FIG. 1 or 2.

FIG. 8 is a schematic flow chart illustrating a method 200 of forming waste containment system 100 (shown in FIG. 1). Method 200 includes coupling 200 flexible wire 104 about top opening 118 of flexible bag 106 such that wire 104 defines a shape of top opening 118. More specifically, coupling 200 flexible wire 104 about top opening 118 of flexible bag 106 includes integrally forming wire 104 about top opening 118 of bag 106. Method 200 also includes coupling 202 at least one of bag 106 and wire 104 to a flexible frame 102 such that manipulation of wire 104 causes frame 102 to change in shape such that the shape of frame 102 at least partially corresponds to the shape of top opening 118 as defined my wire 104. In one implementation, coupling 202 at least one of bag 106 and wire 104 to a flexible frame 102 includes coupling 202 at least one of bag 106 and wire 104 to flexible frame 102 using hook and loop fasteners 134 and 132. In another implementation, coupling 202 at least one of bag 106 and wire 104 to a flexible frame 102 includes forming curved lip 138 in frame 102 such that lip 138 defines a groove 140 and subsequently coupling the wire 104 within groove 140. Furthermore, coupling 202 at least one of bag 106 and wire 104 to a flexible frame 102 includes coupling 202 at least one of bag 106 and wire 104 to inner surface 116 of frame 102. Method 200 also includes coupling 206 at least one adhesive layer 122 to frame 102 such that adhesive layer 122 is configured to couple frame 102 to structure 107.

Figure 9:
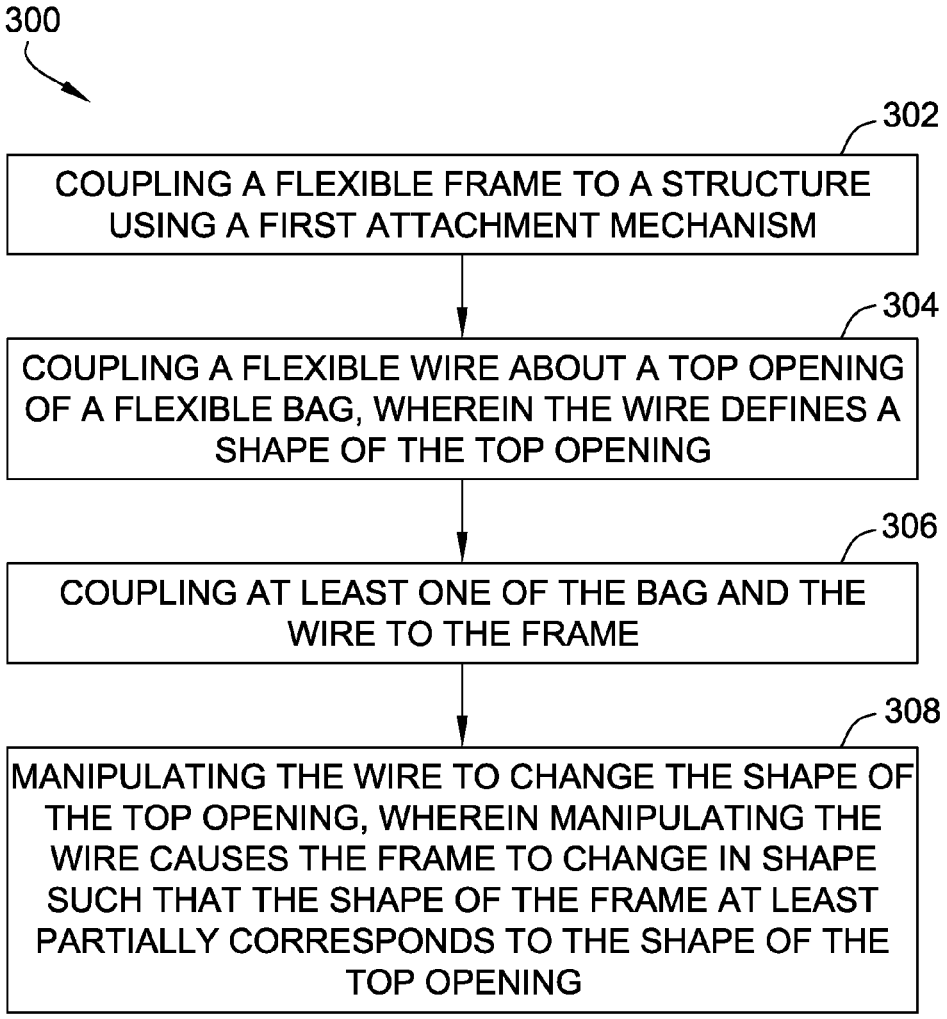
FIG. 9 is a schematic flow chart illustrating a method of operating either of the waste containment systems shown in FIG. 1 or 2.

FIG. 9 is a schematic flow chart illustrating a method 300 of operating waste containment system 100 (shown in FIG. 1). Method 300 includes coupling 302 flexible frame 102 to structure 107 using first attachment mechanism 120. In one implementation, first attachment mechanism 120 includes adhesive 122 and/or hooks 128 and/or openings 130. Method 300 also includes coupling 304 flexible wire 104 about top opening 118 of flexible bag 106 such that flexible wire 104 defines a shape of top opening 118. Method 300 further includes coupling 306 at least one of flexible bag 106 and flexible wire 104 to flexible frame 102 and optionally manipulating 308 flexible wire 104 to change the shape of top opening 118. As described above, manipulating 308 flexible wire 104 causes flexible frame 102 to change in shape such that the shape of flexible frame 102 at least partially corresponds to the shape of top opening 118.

Although not shown in FIG. 9, method 300 also includes removing frame 102 from structure 107 by removing attachment mechanism 120 from structure 107. More specifically, removing attachment mechanism 120 includes removing adhesive 122 and/or hooks 128 from structure 107. Method 300 also includes removing attachment mechanism 120 from flexible frame 102. In implementations using multiple adhesive layers 124 and separating layers 126, once the outermost adhesive layer 124 is removed from structure 107, the outermost separating layer 126 is peeled to remove the used adhesive layer 124 from frame 102 and to reveal a new adhesive layer 124 that may be subsequently coupled to structure 107 in a different position. In implementations using only a single adhesive layer 122, adhesive 122 can be removed from flexible frame 102 to be cleaned before being reapplied to flexible frame 102. Method 300 also includes removing at least one of flexible bag 106 and flexible wire 104 from flexible frame 102 and recoupling either the same flexible bag 106 or a new flexible bag 106 to from. More specifically, in one implementation, flexible wire 104 and flexible bag 106 are removable from flexible frame 102 to facilitate emptying of flexible bag 106 before that same flexible bag 106 is recoupled to flexible frame 102. In another implementation, flexible wire 104 and flexible bag 106 are disposable such that once flexible bag 106 is full or the work is complete, flexible wire 104 and flexible bag 106 are removed from flexible frame 102 and disposed of before a new flexible wire 104 and flexible bag 106 are coupled to the same flexible frame 102.

The examples described herein facilitate containing various types of waste in a flexible bag mounted to a structure into which a technician drills. The waste containment system herein described includes a frame, a wire, and a bag that are each flexible so the system can be configured in any desirable shape or profile. More specifically, each of the frame, wire, and bag are flexible to facilitate enabling a technician to form the waste containment system into a desired shape or profile during use while the system is coupled to a structure. As described herein, the wire is flexible such that a technician is able mold the wire to define a desired shape of a top opening of the bag, but also rigid enough to maintain its shape to provide structure for the bag and to maintain deformations in the frame as a result of molding the wire. As such, manipulating the wire to change the shape of the top opening causes the frame to change in shape such that the shape of deformed the frame at least partially corresponds to the shape of the top opening as defined by the wire. Accordingly, a technician deforms the wire in order to catch and contain a maximum amount of waste created during working conditions.

Furthermore, in operation, the waste containment system includes at least one of the following technical effects: 1) containing waste generated above the system to facilitate capturing waste particles that may burn or otherwise irritate a technician's skin, 2) increases the safety of the manufacturing facility, 3) increases the cleanliness of the build, 4) facilitates hands-free containment of waste particles through usage of the adhesive, hook, and/or fastener opening attachment mechanisms.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose various embodiments, which include the best mode, to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A waste containment system comprising:

a flexible bag having a top opening;

a flexible wire coupled to said bag, said wire positioned about said top opening and configured to define a shape of said top opening; and a flexible frame comprising:

a first attachment mechanism configured to couple said frame to a structure; and a second attachment mechanism configured to couple said frame to at least one of said wire and said bag, wherein manipulation of said wire causes said frame to change in shape such that the shape of said frame at least partially corresponds to the shape of said top opening.

2. The waste containment system in accordance with claim 1, wherein said first attachment mechanism comprises at least one of a hook, an opening configured to receive a fastener, and an adhesive.

3. The waste containment system in accordance with claim 2, wherein said adhesive is free of silicone, re-useable, and removable from said frame.

4. The waste containment system in accordance with claim 2, wherein said adhesive comprises a plurality of alternating adhesive layers and separating layers.

5. The waste containment system in accordance with claim 1, wherein said second attachment mechanism comprises one of a hook or loop fastener coupled to said frame and a remaining hook or loop fastener coupled to said bag.

6. The waste containment system in accordance with claim 1, wherein said second attachment mechanism comprises a curved lip formed in said frame, said lip defining a groove configured to receive said wire.

7. The waste containment system in accordance with claim 1, wherein said wire is integrally formed with said bag.

8. The waste containment system in accordance with claim 1, wherein said bag is formed from a fire-retardant material.

9. The waste containment system in accordance with claim 1, wherein at least one of said bag and said wire are coupled to an outer surface of said frame.

10. A method of forming a waste containment system, said method comprising:

coupling a flexible wire about a top opening of a flexible bag, wherein the wire defines a shape of the top opening; and coupling at least one of the bag and the wire to a flexible frame, wherein manipulation of the wire causes the frame to change in shape such that the shape of the frame at least partially corresponds to the shape of the top opening.

11. The method in accordance with claim 10, wherein coupling at least one of the bag and the wire to a flexible frame comprises coupling at least one of the bag and the wire to a flexible frame using hook and loop fasteners.

12. The method in accordance with claim 10, wherein coupling at least one of the bag and the wire to a flexible frame comprises:

forming a curved lip in the frame such that the lip defines a groove; and coupling the wire within the groove.

13. The method in accordance with claim 10, wherein coupling a flexible wire about a top opening of a flexible bag comprises integrally forming the wire about the top opening of the bag.

14. The method in accordance with claim 10, further comprising coupling at least one adhesive layer to the frame, wherein the at least one adhesive layer is configured to couple the frame to a structure.

15. The method in accordance with claim 10, wherein coupling at least one of the bag and the wire to the frame comprises coupling at least one of the bag and the wire to an inner surface of the frame.

16. A method of operating a waste containment system, said method comprising:

coupling a flexible frame to a structure using a first attachment mechanism;

coupling a flexible wire about a top opening of a flexible bag, wherein the wire defines a shape of the top opening;

coupling at least one of the bag and the wire to the frame;

manipulating the wire to change the shape of the top opening, wherein manipulating the wire causes the frame to change in shape such that the shape of the frame at least partially corresponds to the shape of the top opening.

17. The method according to claim 16, further comprising removing the frame from the structure by removing the attachment mechanism from the structure.

18. The method according to claim 16, further comprising removing the attachment mechanism from the frame.

19. The method according to claim 16, further comprising removing at least one of the bag and the wire from the frame.

20. The method according to claim 19, further comprising recoupling one of a second bag and a second wire to the frame.

* * * * *